US011248848B1

(12) United States Patent
Huang

(10) Patent No.: US 11,248,848 B1
(45) Date of Patent: Feb. 15, 2022

(54) LIQUID-COOLING HEAT DISSIPATION APPARATUS

(71) Applicant: Huizhou Hanxu Hardware Plastic Technology Co., Ltd., Guangdong (CN)

(72) Inventor: Tsung-Hsien Huang, Guangdong (CN)

(73) Assignee: HUIZHOU HANXU HARDWARE PLASTIC TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/170,903

(22) Filed: Feb. 9, 2021

(30) Foreign Application Priority Data

Dec. 9, 2020 (CN) ..... 202011427259.6

(51) Int. Cl.
*F28D 1/03* (2006.01)

(52) U.S. Cl.
CPC ..... *F28D 1/0341* (2013.01); *F28F 2250/08* (2013.01); *F28F 2275/06* (2013.01)

(58) Field of Classification Search
CPC ..... F28D 1/0341; F28D 1/05375; F28F 2250/08; F28F 2275/06; H01L 23/4735; H01L 21/4882
See application file for complete search history.

(56) References Cited

U.S. PATENT DOCUMENTS

| | | | | |
|---|---|---|---|---|
| 1,306,976 | A * | 6/1919 | Searles | F04D 25/166 165/121 |
| 9,927,181 | B2 * | 3/2018 | Mounioloux | F28D 1/05375 |
| 10,609,841 | B2 * | 3/2020 | Xiao | H01L 23/4735 |
| 2006/0051222 | A1 * | 3/2006 | Lee | F04D 13/064 417/423.14 |
| 2007/0034353 | A1 * | 2/2007 | Liu | H01L 23/473 165/80.4 |
| 2013/0299139 | A1 * | 11/2013 | Mounioloux | G06F 1/20 165/120 |
| 2021/0180890 | A1 * | 6/2021 | Cheng | F04D 29/605 |

* cited by examiner

*Primary Examiner* — Jon T. Schermerhorn, Jr.
(74) *Attorney, Agent, or Firm* — Leong C. Lei

(57) ABSTRACT

A liquid-cooling heat dissipation apparatus includes a water distribution box, a water collection box, a first radiating pipe, a second radiating pipe, a third radiating pipe, a fourth radiating pipe, and a pumping device. The channels in the liquid-cooling heat dissipation apparatus are connected in sequence to form a circuitous configuration. This allows the water to travel a longer distance in the liquid-cooling heat dissipation apparatus, so that the liquid-cooling heat dissipation apparatus can effectively cool the water and dissipate heat.

10 Claims, 10 Drawing Sheets

LIQUID-COOLING HEAT DISSIPATION APPARATUS

BACKGROUND OF THE INVENTION

1. Field of the Invention

The present invention relates to a heat dissipation apparatus, and more particularly to a liquid-cooling heat dissipation apparatus.

2. Description of the Prior Art

A water-cooling radiator is configured to radiate the heat of the radiator using a liquid under the action of a pump. Compared with air cooling, the water-cooling radiator has the advantages of quietness, stable cooling, and less dependence on the environment. The heat dissipation performance of the water-cooling radiator is proportional to the flow rate of a cooling liquid (water or other liquid). The flow rate of the cooling liquid is related to the power of the pump in the cooling system. Moreover, the heat capacity of water is large. This makes the water-cooling system have a good heat load capacity.

A conventional water-cooling radiator assembly usually consists of a water-cooling radiator, a water-cooling block, and a water pipe. The water pipe is connected between the water-cooling radiator and the water-cooling block. The water pipe allows the water to circulate in the water-cooling radiator and the water-cooling block. After the water absorbs the heat from the water-cooling block, the water flows to the water-cooling radiator for heat dissipation, and the water after heat dissipation flows back to the water-cooling block.

In the prior art, the channels of the water-cooling radiator of the water-cooling radiator assembly are U-shaped. This results in that the water travels a short distance in the water-cooling radiator, so the water-cooling radiator cannot effectively cool the water and dissipate heat. The flow rate of water in water-cooling radiator is slower, and the heat dissipation efficiency is lower. Therefore, it is necessary to improve the conventional water-cooling radiator.

SUMMARY OF THE INVENTION

In view of the defects of the prior art, the primary object of the present invention is to provide a liquid-cooling heat dissipation apparatus, which can effectively solve the problem that the conventional water-cooling radiator cannot effectively cool the water and dissipate heat.

In order to achieve the above object, the present invention adopts the following technical solutions:

A liquid-cooling heat dissipation apparatus comprises a water distribution box, a water collection box, a first radiating pipe, a second radiating pipe, a third radiating pipe, a fourth radiating pipe, and a pumping device.

The water distribution box is made of a heat-dissipating metal material. A plurality of first partitions is provided in the water distribution box to divide an inside of the water distribution box into a water inlet chamber, a transition chamber and a water outlet chamber. The water distribution box is formed with a water inlet, a water outlet, a first installation groove, a second installation groove and a third installation groove. The water inlet and the first installation groove communicate with the water inlet chamber. The water outlet and the second installation groove communicate with the water outlet chamber. The third installation groove communicates with the transition chamber.

The water collection box is made of a heat-dissipating metal material. At least one second partition is provided in the water collection box to divide an inside of the water collection box into a first water collection chamber and a second water collection chamber. The water collection box is formed with a fourth installation groove and a fifth installation groove. The fourth installation groove communicates with the first water collection chamber. The fifth installation groove communicates with the second water collection chamber.

The first radiating pipe, the second radiating pipe, the third radiating pipe and the fourth radiating pipe are all provided with radiating fins. One end of the first radiating pipe is hermetically installed in the first installation groove and communicates with the water inlet chamber. Another end of the first radiating pipe is hermetically installed in the corresponding fourth installation groove and communicates with the first water collection chamber. One end of the second radiating pipe is hermetically installed in the corresponding third installation groove and communicates with the transition chamber. Another end of the second radiating pipe is hermetically installed in the corresponding fourth installation groove and communicates with the first water collection chamber. One end of the third radiating pipe is hermetically installed in the third installation groove and communicates with the transition chamber. Another end of the third radiating pipe is hermetically installed in the corresponding fifth installation groove and communicates with the second water collection chamber. The third radiating pipe is cut into at least two sections. One end of the fourth radiating pipe is hermetically installed in the second installation groove and communicates with the water outlet chamber. Another end of the fourth radiating pipe is hermetically installed in the corresponding fifth installation groove and communicates with the second water collection chamber.

The pumping device is integrally arranged between the adjacent two sections of the third radiating pipe. The pump device includes a main box body and a water pump cover. The main box body is made of a heat-dissipating metal material. A water pump cavity is formed in the main box body. A main partition is provided in the main box body to divide an inside of the main box body into a water inlet cavity and a water outlet cavity. The water outlet cavity communicates with the water pump cavity. One side of the main box body is provided with a sixth installation groove communicating with the water inlet cavity. Another side of the main box body is provided with a seventh installation groove communicating with the water outlet cavity. Ends of the two adjacent sections of the third radiating pipe are hermetically installed in the sixth installation groove and the seventh installation groove to communicate with the water inlet cavity and the water outlet cavity, respectively. The water pump cover is fixed to the main box body and configured to seal an opening of the water pump cavity. A water pump is fixed to an inner side of the water pump cover. An impeller is connected to an output shaft of the water pump. The impeller is located in the water pump cavity and is driven to rotate by the water pump.

Compared with the prior art, the present invention has obvious advantages and beneficial effects. Specifically, it can be known from the above technical solutions:

Multiple chambers are formed by arranging partitions in both the water distribution box and the water collection box, and each radiating pipe is in communication with the corresponding chambers, so that the channels in this product are connected in sequence to form a circuitous configuration. This allows the water to travel a longer distance in the water-cooling radiator, so that the water-cooling radiator can effectively cool the water and dissipate heat. Furthermore, a pumping device is provided to effectively speed up the flow of water and improve the heat dissipation efficiency. The overall heat dissipation effect of the product is very good.

DETAILED DESCRIPTION OF THE PREFERRED EMBODIMENTS

Figure 1:
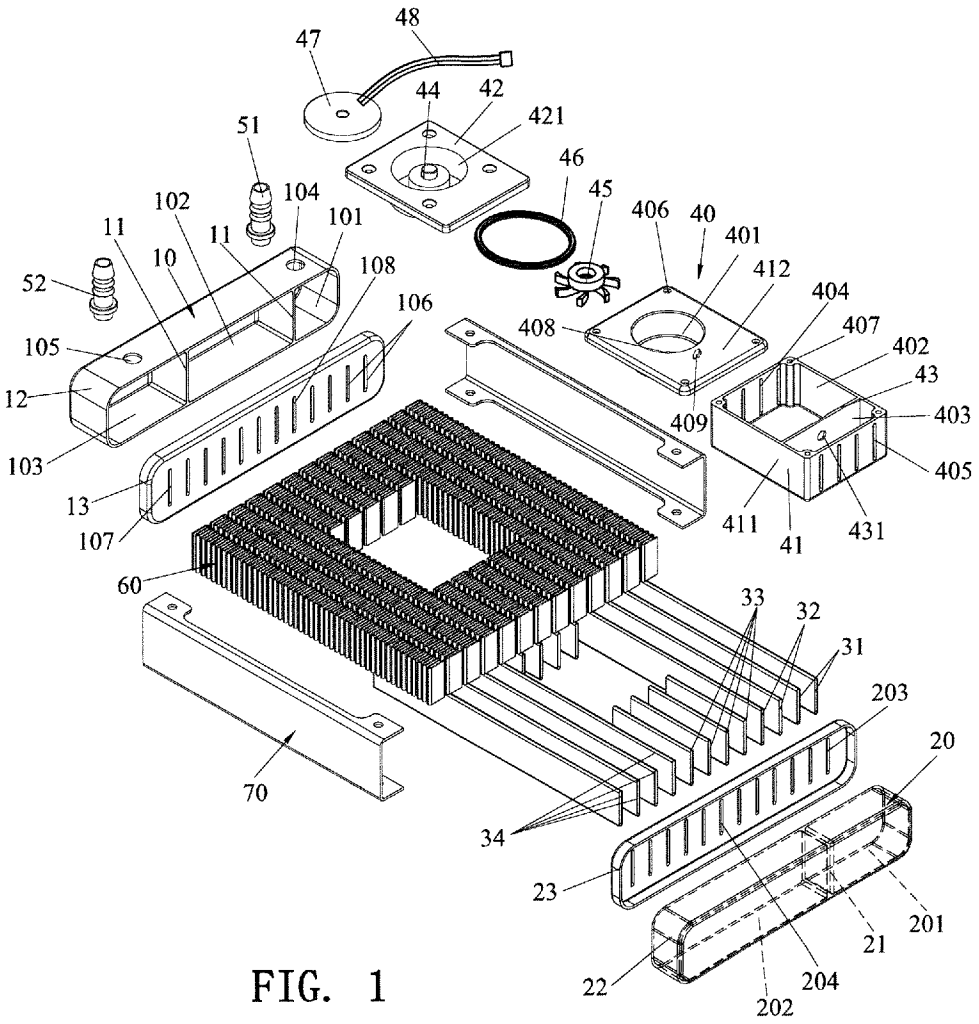
FIG. 1 is an exploded view according to a first embodiment of the present invention.
Figure 2:
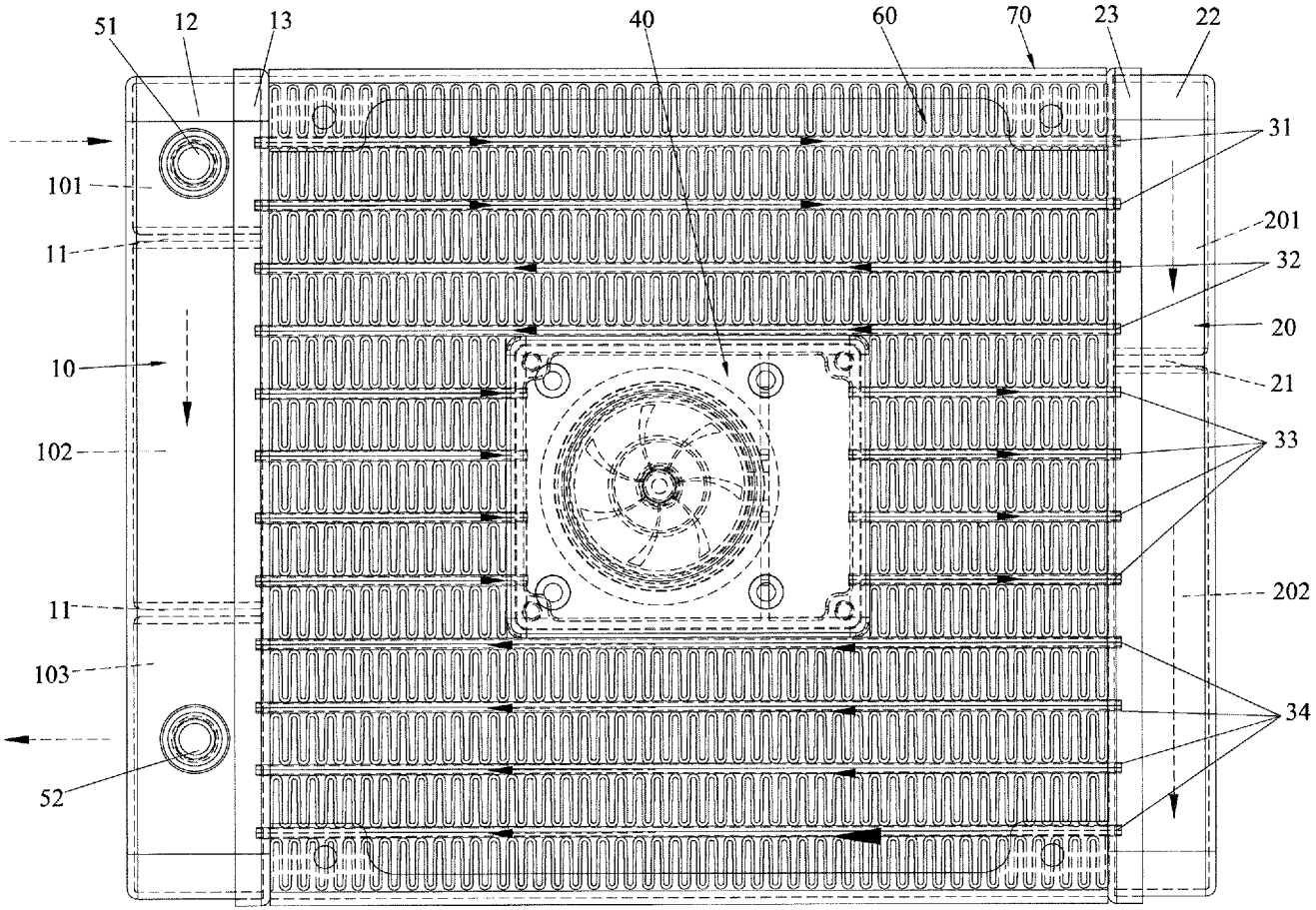
FIG. 2 is a top view according to the first embodiment of the present invention.
Figure 3:
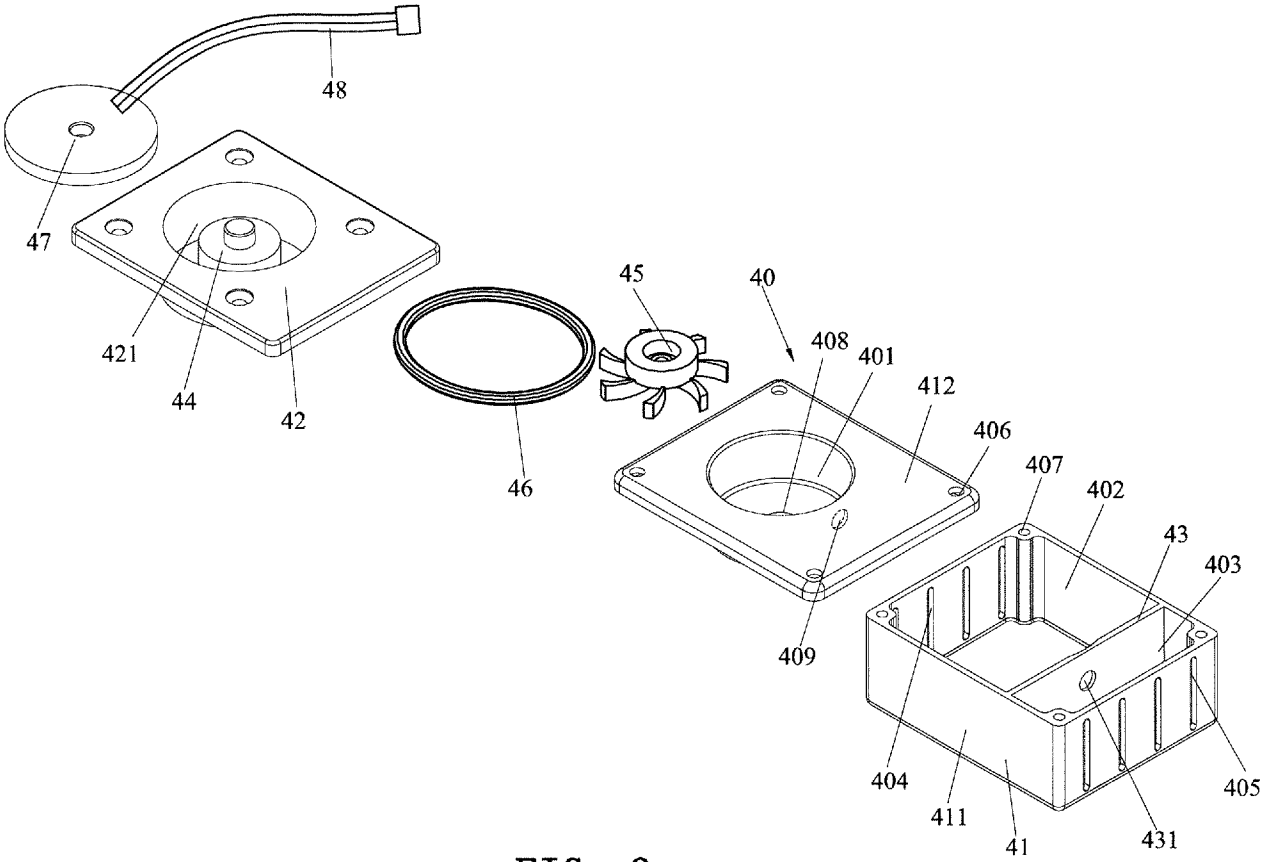
FIG. 3 is a partial exploded view according to the first embodiment of the present invention.

FIGS. 1-5 show the specific structure of a first embodiment of the present invention, comprising a water distribution box 10, a water collection box 20, a first radiating pipe 31, a second radiating pipe 32, a third radiating pipe 33, a fourth radiating pipe 34, and a pumping device 40.

The water distribution box 10 is made of a heat-dissipating metal material. A plurality of first partitions 11 is provided in the water distribution box 10 to divide the inside of the water distribution box 10 into a water inlet chamber 101, a transition chamber 102 and a water outlet chamber 103. The water distribution box 10 is formed with a water inlet 104, a water outlet 105, a first installation groove 106, a second installation groove 107 and a third installation groove 108. The water inlet 104 and the first installation groove 106 communicate with the water inlet chamber 101. The water outlet 105 and the second installation groove 107 communicate with the water outlet chamber 103. The third installation groove 108 communicates with the transition chamber 102. Specifically, the water distribution box 10 includes a first box body 12 and a first box cover 13. The first partitions 11 are installed in the first box body 12 by welding or integrally formed with the first box body 12. The first box cover 13 and the first box body 12 are hermetically connected together to form the water inlet chamber 101, the transition chamber 102 and the water outlet chamber 103. The water inlet 104 and the water outlet 105 are arranged on the first box body 12. A water inlet pipe joint 51 is hermetically connected to the water inlet 104. A water outlet pipe joint 52 is hermetically connected to the water outlet 105. The first installation groove 106, the second installation groove 107 and the third installation groove 108 are all arranged on the first box cover 13. The water inlet pipe joint 51 is inserted in the water inlet 104 and is hermetically fixed to the first box body 12 by welding. The water outlet pipe joint 52 is inserted in the water outlet 105 and is hermetically fixed to the first box body 12 by welding. The first box body 12 and the first box cover 13 are made of copper or aluminum. The first box cover 13 is hermetically fixed to the first box body 12 by welding.

The water collection box 20 is also made of a heat-dissipating metal material. At least one second partition 21 is provided in the water collection box 20 to divide the inside of the water collection box 20 into a first water collection chamber 201 and a second water collection chamber 202. The water collection box 20 is formed with a fourth installation groove 203 and a fifth installation groove 204. The fourth installation groove 203 communicates with the first water collection chamber 201. The fifth installation groove 204 communicates with the second water collection chamber 202. Specifically, the water collection box 20 includes a second box body 22 and a second box cover 23. The second partition 21 is installed in the second box body 22 by welding or integrally formed with the second box body 22. The second box cover 23 and the second box body 22 are hermetically connected together to form the first water collection chamber 201 and the second water collection chamber 202. The fourth installation groove 203 and the fifth installation groove 204 are arranged on the second box cover 23. The second box body 22 and the second box cover 23 are made of copper or aluminum. The second box cover 23 is hermetically fixed to the second box body 22 by welding.

The first radiating pipe 31, the second radiating pipe 32, the third radiating pipe 33 and the fourth radiating pipe 34 are all provided with radiating fins 60. In this embodiment, the first radiating pipe 31, the second radiating pipe 32, the third radiating pipe 33 and the fourth radiating pipe 34 are all heat-dissipating metal flat pipes. Of course, they may be heat-dissipating metal round pipes, but not limited thereto. Both ends of the first radiating pipe 31, the second radiating pipe 32, the third radiating pipe 33 and the fourth radiating pipe 34 are welded and fixed to the water distribution box 10 and the water collection box 20, respectively.

One end of the first radiating pipe 31 is hermetically installed in the first installation groove 106 and communicates with the water inlet chamber 101, and the other end of the first radiating pipe 31 is hermetically installed in the corresponding fourth installation groove 203 and communicates with the first water collection chamber 201. In this embodiment, the first radiating pipe 31 includes two first radiating pipes arranged side by side at an interval, but not limited thereto.

One end of the second radiating pipe 32 is hermetically installed in the corresponding third installation groove 108 and communicates with the transition chamber 102, and the other end of the second radiating pipe 32 is hermetically installed in the corresponding fourth installation groove 203 and communicates with the first water collection chamber 201. In this embodiment, the second radiating pipe 32 includes two second radiating pipes arranged side by side at an interval, but not limited thereto.

One end of the third radiating pipe 33 is hermetically installed in the third installation groove 108 and communicates with the transition chamber 102, and the other end of the third radiating pipe 33 is hermetically installed in the corresponding fifth installation groove 204 and communicates with the second water collection chamber 202. The third radiating pipe 33 is cut into at least two sections. In this embodiment, the third radiating pipe 33 is cut into front and rear two sections. In this embodiment, the third radiating pipe 33 includes four third radiating pipes arranged side by side at intervals, but not limited thereto.

One end of the fourth radiating pipe 34 is hermetically installed in the second installation groove 107 and communicates with the water outlet chamber 103, and the other end of the fourth radiating pipe 34 is hermetically installed in the corresponding fifth installation groove 204 and communicates with the second water collection chamber 202. In this embodiment, the fourth radiating pipe 34 includes four fourth radiating pipes arranged side by side at intervals, but not limited thereto.

The pumping device 40 is integrally arranged between the two adjacent sections of the third radiating pipe 33. The pump device 40 includes a main box body 41 and a water pump cover 42. The main box body 41 is also made of a heat-dissipating metal material. A water pump cavity 401 is formed in the main box body 41. A main partition 43 is provided in the main box body 41 to divide the inside of the main box body 41 into a water inlet cavity 402 and a water outlet cavity 403. The water outlet cavity 403 communicates with the water pump cavity 401. One side of the main box body 41 is provided with a sixth installation groove 404 communicating with the water inlet cavity 402. The other side of the main box body 41 is provided with a seventh installation groove 405 communicating with the water outlet cavity 403. The ends of the two adjacent sections of the third radiating pipe 33 are hermetically installed in the sixth installation groove 404 and the seventh installation groove 405 to communicate with the water inlet cavity 402 and the water outlet cavity 403, respectively. The water pump cover 42 is fixed to the main box body 41 and configured to seal the opening of the water pump cavity 401. A water pump 44 is fixed to the inner side of the water pump cover 42. An impeller 45 is connected to an output shaft of the water pump 44. The impeller 45 is located in the water pump cavity 401 and is driven to rotate by the water pump 44.

In this embodiment, the main box body 41 includes a bottom box 411 and a top cover 412. The main partition 43 is installed in the bottom box 411 by welding or integrally formed with the bottom box 411. The water inlet cavity 402 and the water outlet cavity 403 are formed in the bottom box 411. The water inlet cavity 402 and the water outlet cavity 403 have openings facing upward. The sixth installation groove 404 and the seventh installation groove 405 are arranged on two sides of the bottom box 411, respectively. The top cover 412 is fixed to the bottom box 411 and configured to seal and cover the openings of the water inlet cavity 402 and the water outlet cavity 403. The top cover 412 is formed with the water pump cavity 401. Each corner of the top cover 412 is formed with a first fixing hole 406. Each corner of the bottom box 411 is formed with a second fixing hole 407. A fixing screw passes through the first fixing hole 406 and the second fixing hole 407 to fix the top cover 412 and the bottom box 411. The water pump cover 42 is hermetically connected to the top cover 412. In this embodiment, a sealing ring 46 is sandwiched between the water pump cover 42 and the top cover 412. The top of the top cover 412 is recessed to form the water pump cavity 401. The inner bottom of the water pump cavity 401 is provided with a first through hole 408. The first through hole 408 communicates with the water inlet cavity 402. The inner peripheral side wall of the water pump cavity 401 is provided with a second through hole 409. The main partition 43 is provided with a third through hole 431. The third through hole 431 faces and communicates with the second through hole 409. The top of the water pump cover 42 is formed with a recess 421. A printed circuit board 47 is inserted in the recess 421. The printed circuit board 47 is electrically connected to the water pump 44. The printed circuit board 47 is connected with a power wire 48. The power wire 48 is configured to be connected with an external power source.

In addition, two fan brackets 70 are connected between the water distribution box 10 and the water collection box 20. The two fan brackets 70 are bilaterally symmetrical. The first radiating pipe 31, the second radiating pipe 32, the third radiating pipe 33 and the fourth radiating pipe 34 are located between the two fan brackets 70, so that the overall structure of the product is more stable, and a fan can be installed and fixed.

Figure 4:
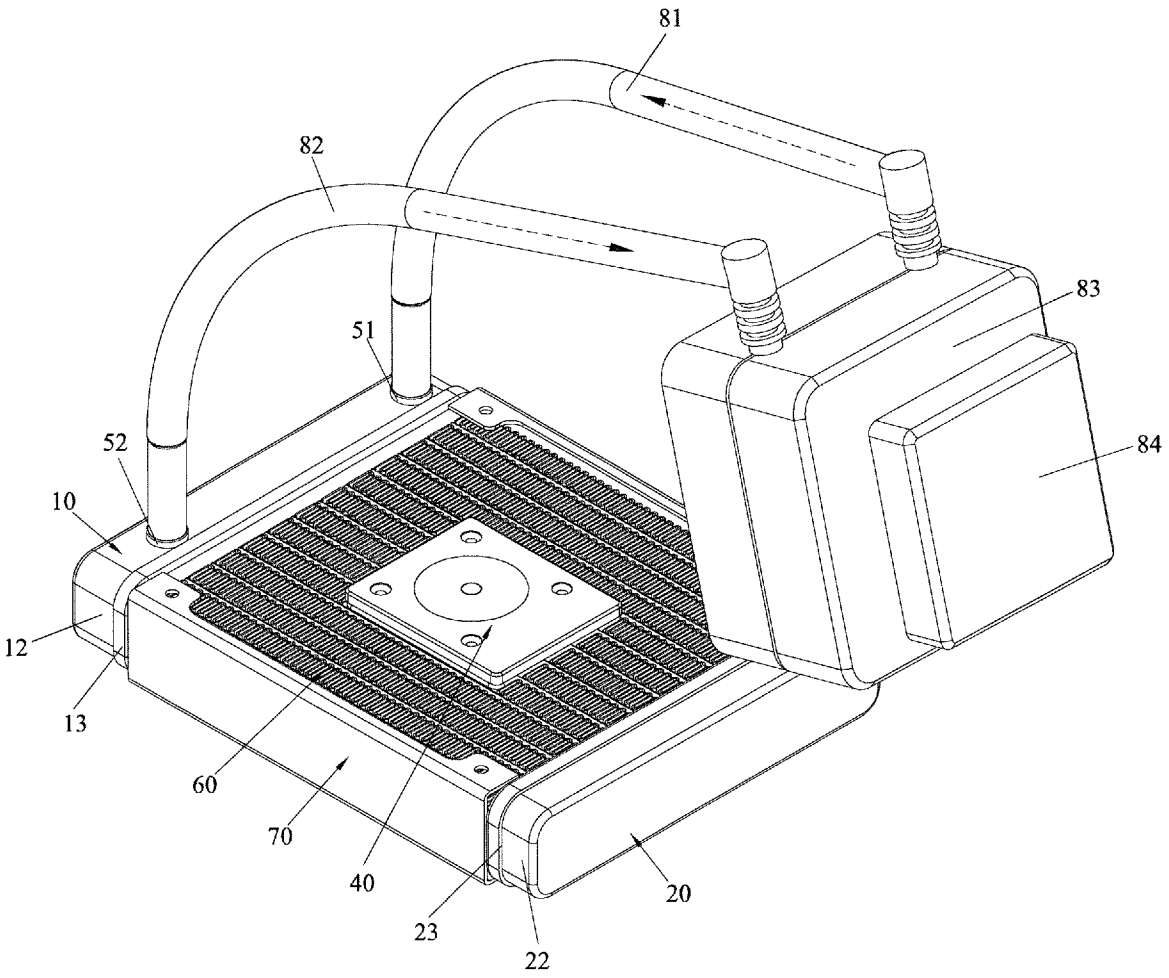
FIG. 4 is a perspective view according to the first embodiment of the present invention when in use.
Figure 5:
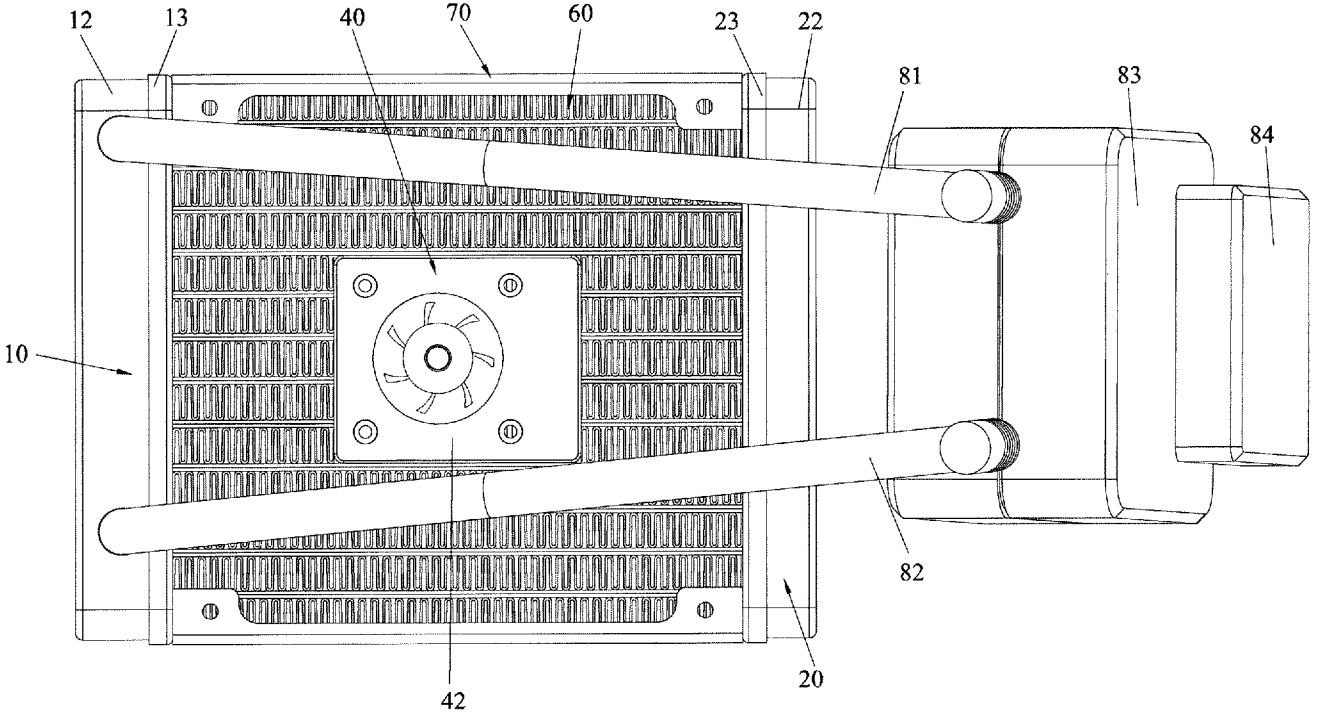
FIG. 5 is a top view of FIG. 4.
Figure 6:
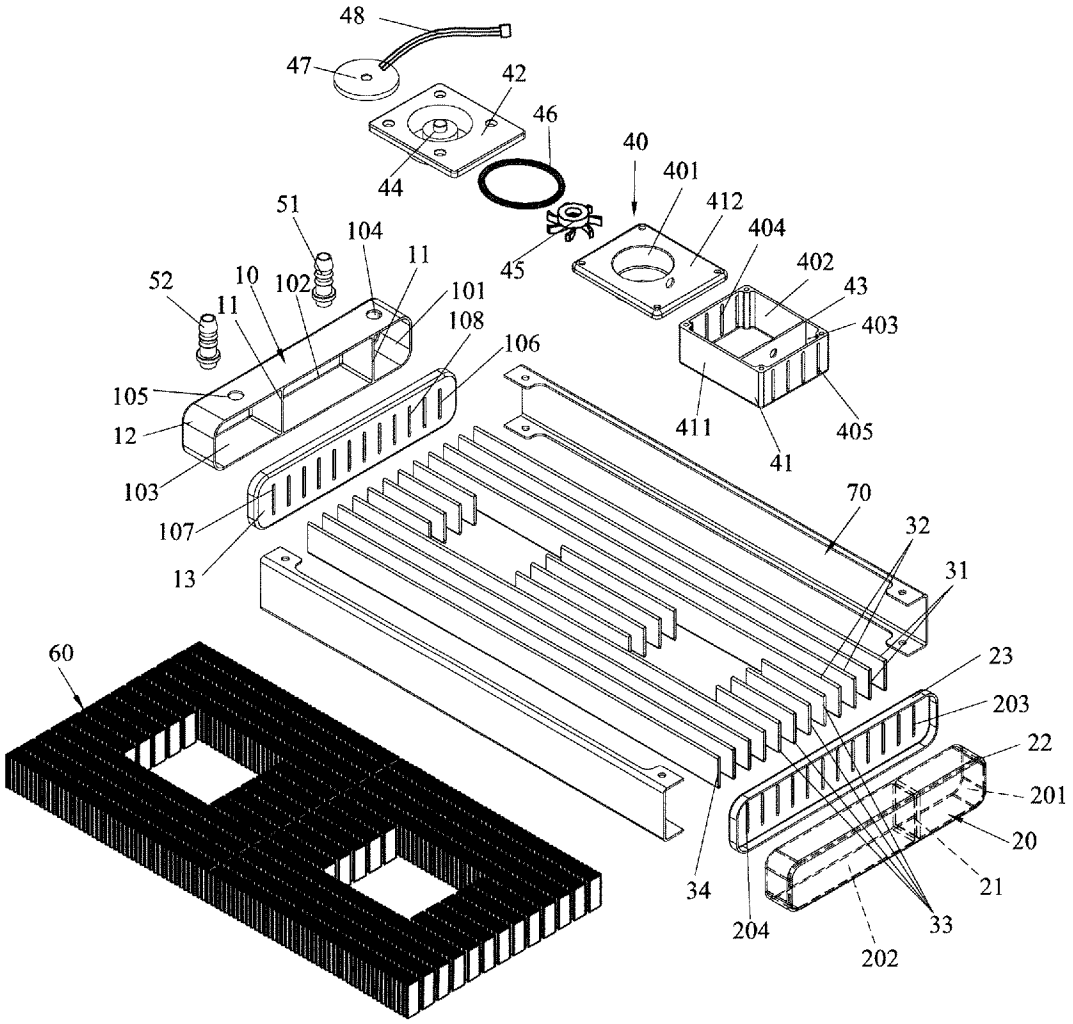
FIG. 6 is an exploded view according to a second embodiment of the present invention.
Figure 7:
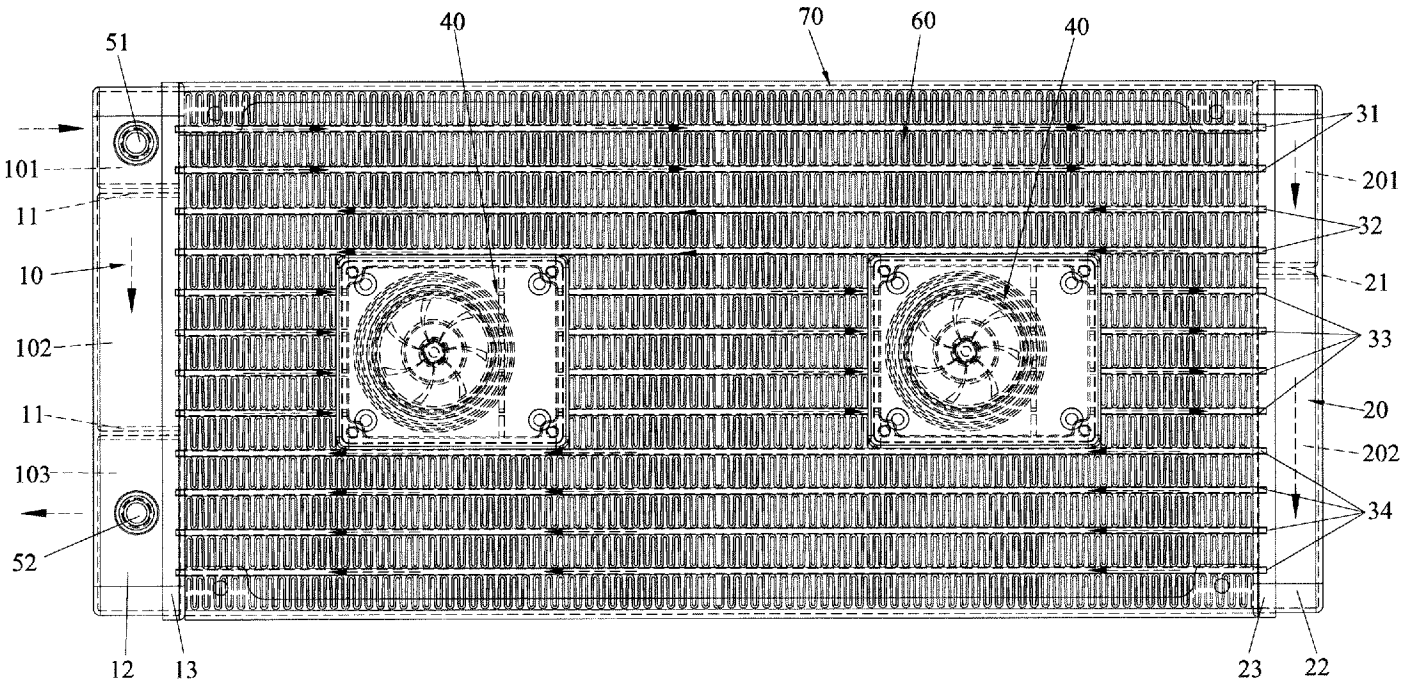
FIG. 7 is a top view according to the second embodiment of the present invention.
Figure 8:
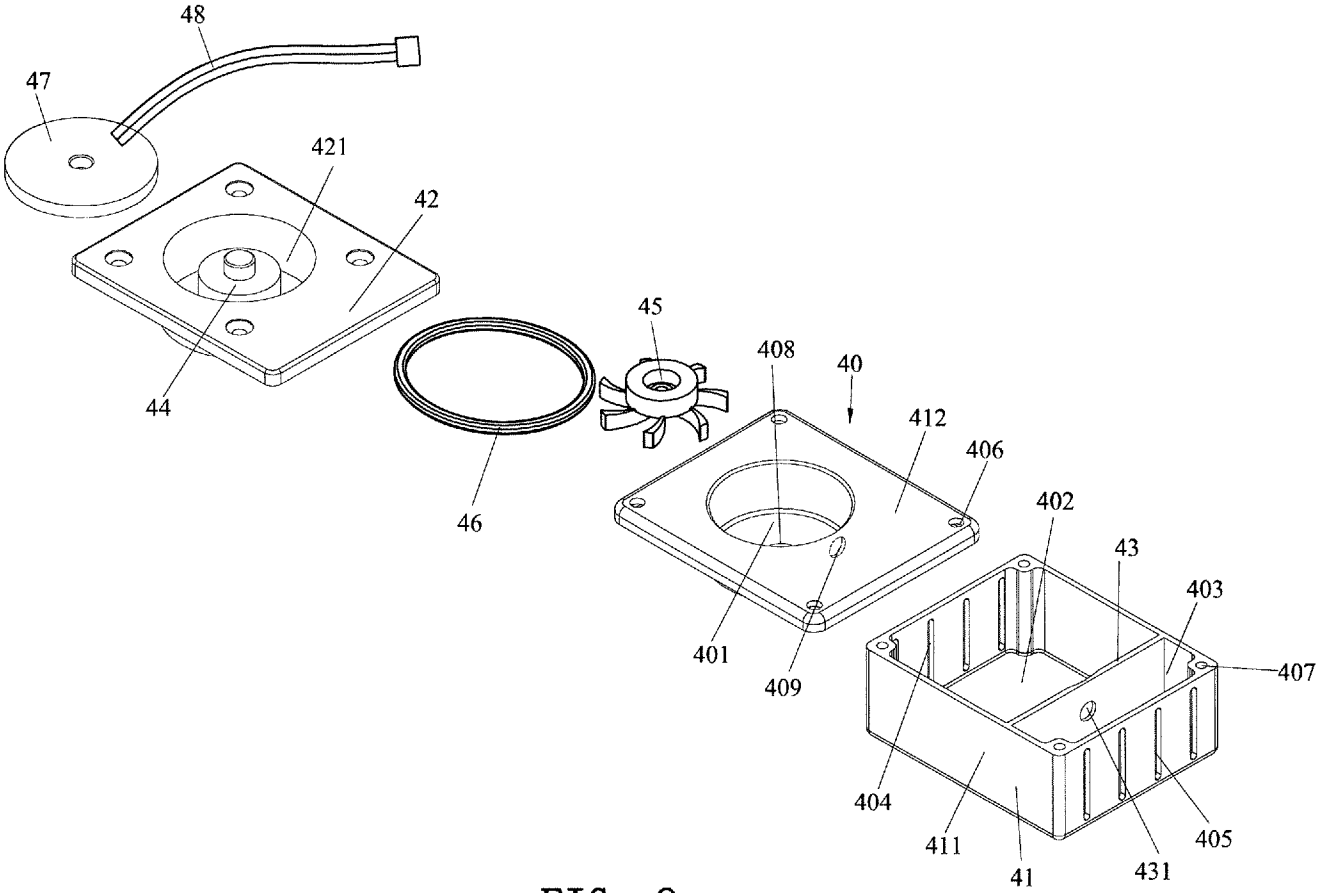
FIG. 8 is a partial exploded view according to the second embodiment of the present invention.
Figure 9:
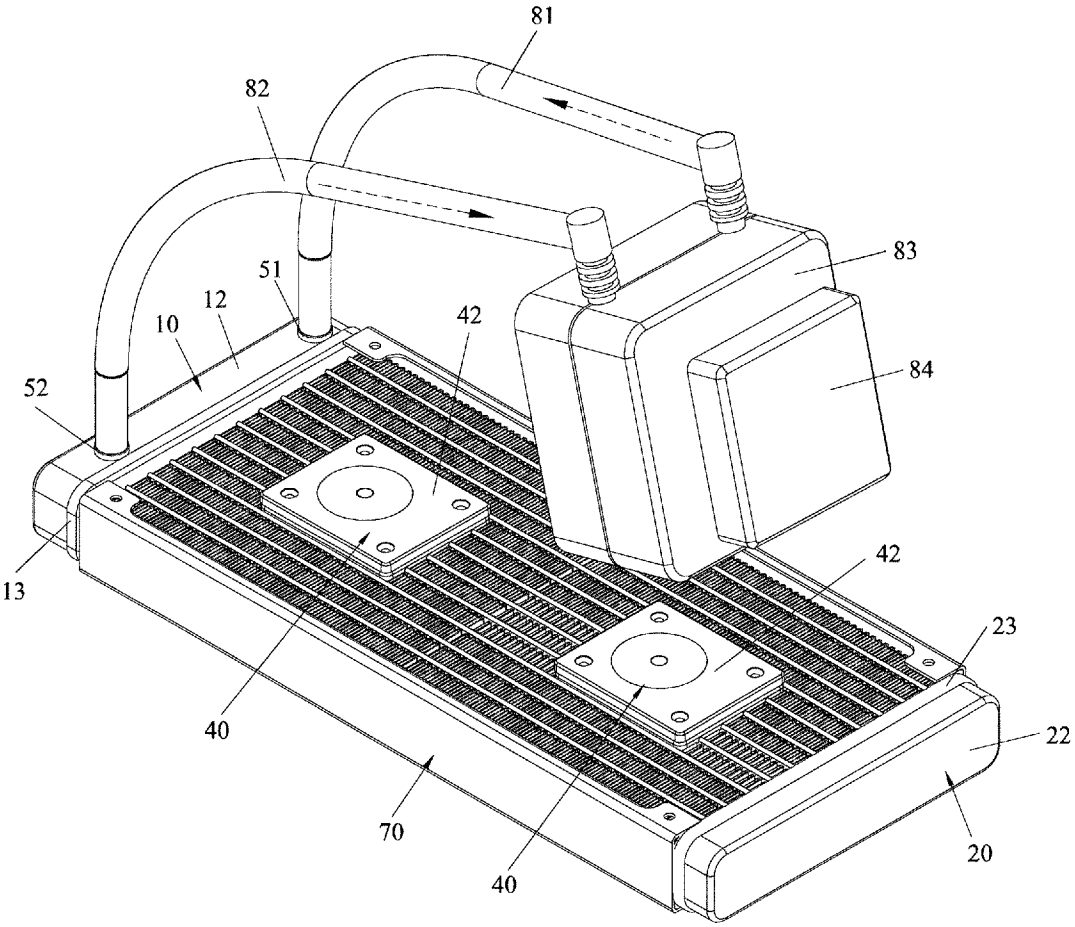
FIG. 9 is a perspective view according to the second embodiment of the present invention when in use.
Figure 10:
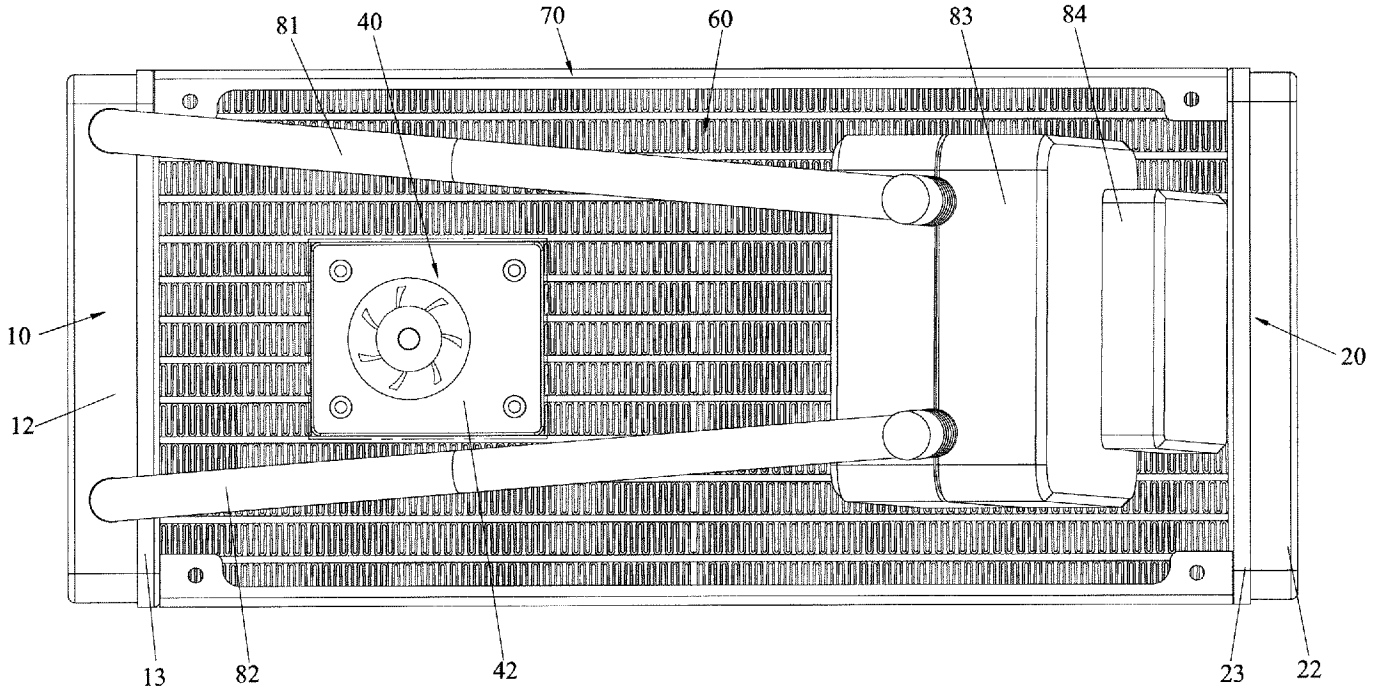
FIG. 10 is a top view of FIG. 9.

The working principle of this embodiment is described in detail as follows:

When in use, as shown in FIG. 4 and FIG. 5, the water inlet pipe joint 51 and the water outlet pipe joint 52 are connected with a water inlet pipe 81 and a water outlet pipe 82, respectively. The water inlet pipe 81 and the water outlet pipe 82 are in communication with an outlet and an inlet of a water-cooling block 83, respectively. An electronic component 84 is attached to the water-cooling block 83. In the working process, the heat generated by the operation of the electronic component 84 causes the water temperature in the water-cooling block 83 to rise. The water with a higher temperature is output from the outlet of the water-cooling block 83 and to the water inlet pipe joint 51 through the water inlet pipe 81, and then the water flows into the water inlet chamber 101. Then, the water flows through the first radiating pipe 31, the first water collection chamber 201, the second radiating pipe 32, the transition chamber 102, the third radiating pipe 33, the second water collection chamber 202, the fourth radiating pipe 34 and the water outlet chamber 103. Finally, the water flows out from the water outlet pipe joint 52. When the water flows through the third radiating pipe 33, the water is powered by the pumping device 40, so as to speed up the flow of water. The temperature of the water gradually decreases as it flows through the water inlet chamber 101, the first radiating pipe 31, the first water collection chamber 201, the second radiating pipe 32, the transition chamber 102, the third radiating pipe 33, the pumping device 34, the second water collection chamber 202, the fourth radiating pipe 34 and the water outlet chamber 103. The temperature of the water output from the water outlet pipe joint 52 is low, which achieves a good cooling effect. The water with a lower temperature is delivered from the water outlet pipe 82 to the water-cooling block 83 to continue to absorb the heat generated by the electronic component 84, so that the temperature of the electronic component 84 is kept at a relatively low temperature. As a result, the electronic component 84 operates stably and will not operate abnormally due to excessive temperature.

FIGS. 6 to 10 show the specific structure of a second embodiment of the present invention. The specific structure of the second embodiment is substantially similar to the specific structure of the first embodiment with the exceptions described hereinafter.

In this embodiment, the third radiating pipe 33 is cut into three sections. The pumping device 40 is integrally arranged between every adjacent two of the sections of the third radiating pipe 33. By providing two pumping devices 40, the flow of water in the third radiating pipe 33 can be further speeded up, so as to further improve the heat dissipation efficiency and achieve a better heat dissipation effect.

The working principle of this embodiment is the same as that of the aforementioned first embodiment, and the working principle of this embodiment will not be described in detail here.

What is claimed is:

1. A liquid-cooling heat dissipation apparatus, comprising a water distribution box, a water collection box, a first radiating pipe, a second radiating pipe, a third radiating pipe, a fourth radiating pipe, and a pumping device;

the water distribution box being made of a heat-dissipating metal material, a plurality of first partitions being provided in the water distribution box to divide an inside of the water distribution box into a water inlet chamber, a transition chamber and a water outlet chamber, the water distribution box being formed with a water inlet, a water outlet, a first installation groove, a second installation groove and a third installation groove, the water inlet and the first installation groove communicating with the water inlet chamber, the water outlet and the second installation groove communicating with the water outlet chamber, the third installation groove communicating with the transition chamber;

the water collection box being made of a heat-dissipating metal material, at least one second partition being provided in the water collection box to divide an inside of the water collection box into a first water collection chamber and a second water collection chamber, the water collection box being formed with a fourth installation groove and a fifth installation groove, the fourth installation groove communicating with the first water collection chamber, the fifth installation groove communicating with the second water collection chamber;

the first radiating pipe, the second radiating pipe, the third radiating pipe and the fourth radiating pipe being all provided with radiating fins; one end of the first radiating pipe being hermetically installed in the first installation groove and communicating with the water inlet chamber, another end of the first radiating pipe being hermetically installed in the corresponding fourth installation groove and communicating with the first water collection chamber; one end of the second radiating pipe being hermetically installed in the corresponding third installation groove and communicating with the transition chamber, another end of the second radiating pipe being hermetically installed in the corresponding fourth installation groove and communicating with the first water collection chamber; one end of the third radiating pipe being hermetically installed in the third installation groove and communicating with the transition chamber, another end of the third radiating pipe being hermetically installed in the corresponding fifth installation groove and communicating with the second water collection chamber, the third radiating pipe being cut into at least two sections; one end of the fourth radiating pipe being hermetically installed in the second installation groove and communicating with the water outlet chamber, another end of the fourth radiating pipe being hermetically installed in the corresponding fifth installation groove and communicating with the second water collection chamber;

the pumping device being integrally arranged between the adjacent two sections of the third radiating pipe, the pump device including a main box body and a water pump cover, the main box body being made of a heat-dissipating metal material, a water pump cavity being formed in the main box body, a main partition being provided in the main box body to divide an inside of the main box body into a water inlet cavity and a water outlet cavity, the water outlet cavity communicating with the water pump cavity, one side of the main box body being provided with a sixth installation groove communicating with the water inlet cavity, another side of the main box body being provided with a seventh installation groove communicating with the water outlet cavity, ends of the two adjacent sections of the third radiating pipe being hermetically installed in the sixth installation groove and the seventh installation groove to communicate with the water inlet cavity and the water outlet cavity, respectively; the water pump cover being fixed to the main box body and configured to seal an opening of the water pump cavity, a water pump being fixed to an inner side of the water pump cover, an impeller being connected to an output shaft of the water pump, the impeller being located in the water pump cavity and being driven to rotate by the water pump.

2. The liquid-cooling heat dissipation apparatus as claimed in claim 1, wherein the main box body includes a bottom box and a top cover, the main partition is installed in the bottom box by welding or integrally formed with the bottom box, the water inlet cavity and the water outlet cavity are formed in the bottom box, the water inlet cavity and the water outlet cavity have openings facing upward, the sixth installation groove and the seventh installation groove are arranged on two sides of the bottom box, respectively; the top cover is fixed to the bottom box and configured to seal and cover the openings of the water inlet cavity and the water outlet cavity, the top cover is formed with the water pump cavity; and the water pump cover is hermetically connected to the top cover.

3. The liquid-cooling heat dissipation apparatus as claimed in claim 2, wherein a top of the top cover is recessed to form the water pump cavity, an inner bottom of the water pump cavity is provided with a first through hole, the first through hole communicates with the water inlet cavity, an inner peripheral side wall of the water pump cavity is provided with a second through hole, the main partition is provided with a third through hole, and the third through hole faces and communicates with the second through hole.

4. The liquid-cooling heat dissipation apparatus as claimed in claim 1, wherein a top of the water pump cover is formed with a recess, a printed circuit board is provided in the recess, the printed circuit board is electrically connected to the water pump, and the printed circuit board is connected with a power wire.

5. The liquid-cooling heat dissipation apparatus as claimed in claim 1, wherein the water distribution box includes a first box body and a first box cover, the first partitions are installed in the first box body by welding or integrally formed with the first box body, the first box cover and the first box body are hermetically connected together to form the water inlet chamber, the transition chamber and the water outlet chamber, the first box body and the first box cover are made of copper or aluminum, and the first box cover is hermetically fixed to the first box body by welding.

6. The liquid-cooling heat dissipation apparatus as claimed in claim 5, wherein the water inlet and the water outlet are arranged on the first box body, a water inlet pipe joint is hermetically connected to the water inlet, a water outlet pipe joint is hermetically connected to the water outlet; the first installation groove, the second installation groove and the third installation groove are all arranged on the first box cover, the water inlet pipe joint is inserted in the water inlet and is hermetically fixed to the first box body by welding, and the water outlet pipe joint is inserted in the water outlet and is hermetically fixed to the first box body by welding.

7. The liquid-cooling heat dissipation apparatus as claimed in claim 1, wherein the water collection box includes a second box body and a second box cover, the second partition is installed in the second box body by welding or integrally formed with the second box body, the second box cover and the second box body are hermetically connected together to form the first water collection chamber and the second water collection chamber, the second box body and the second box cover are made of copper or aluminum, and the second box cover is hermetically fixed to the second box body by welding.

8. The liquid-cooling heat dissipation apparatus as claimed in claim 7, wherein the fourth installation groove and the fifth installation groove are arranged on the second box cover.

9. The liquid-cooling heat dissipation apparatus as claimed in claim 1, wherein two fan brackets are connected between the water distribution box and the water collection box, the two fan brackets are bilaterally symmetrical, the first radiating pipe, the second radiating pipe, the third radiating pipe and the fourth radiating pipe are located between the two fan brackets, the first radiating pipe, the second radiating pipe, the third radiating pipe and the fourth radiating pipe are all heat-dissipating metal flat pipes or heat-dissipating metal round pipes, the first radiating pipe includes two first radiating pipes, the second radiating pipe includes two second radiating pipes, the third radiating pipe includes four third radiating pipes, and the fourth radiating pipe includes four fourth radiating pipes.

10. The liquid-cooling heat dissipation apparatus as claimed in claim 1, wherein the third radiating pipe is cut into three sections, and the pumping device is integrally arranged between every adjacent two of the sections of the third radiating pipe.

* * * * *